United States Patent [19]

Steiginga et al.

[11] Patent Number: 4,880,066

[45] Date of Patent: Nov. 14, 1989

[54] ASSEMBLY FOR DIRECTIONAL DRILLING OF BOREHOLES

[75] Inventors: Abe Steiginga; Robert N. Worrall, both of Rijswijk, Netherlands

[73] Assignee: Shell Oil Company, Houston, Tex.

[21] Appl. No.: 147,402

[22] Filed: Jan. 25, 1988

[30] Foreign Application Priority Data

Apr. 13, 1987 [GB] United Kingdom ..... 8708791

[51] Int. Cl.[4] ..... E21B 4/02; E21B 7/08; E21B 17/10

[52] U.S. Cl. ..... 175/75; 175/76; 175/107; 175/325

[58] Field of Search ..... 175/76, 75, 74, 73, 175/61, 107, 92, 325

[56] References Cited

U.S. PATENT DOCUMENTS

| | | | |
|---|---|---|---|
| 2,890,859 | 6/1959 | Garrison | 175/76 |
| 3,561,549 | 2/1971 | Garrison et al. | 175/76 |
| 3,999,901 | 12/1976 | Tschirky | 175/107 X |
| 4,011,917 | 3/1977 | Tiraspolsky et al. | 175/107 |
| 4,040,495 | 8/1977 | Kellner et al. | 175/61 X |
| 4,436,168 | 3/1984 | Dismukes | 175/61 X |
| 4,465,147 | 8/1984 | Feenshe et al. | 175/73 |
| 4,485,879 | 12/1984 | Kamp et al. | 175/61 |
| 4,492,276 | 1/1985 | Kamp | 175/75 X |
| 4,667,751 | 5/1987 | Geczy et al. | 175/61 |
| 4,697,651 | 10/1987 | Dellinger | 175/76 |
| 4,739,842 | 4/1988 | Kruger et al. | 175/76 X |

FOREIGN PATENT DOCUMENTS

| | | | |
|---|---|---|---|
| 2369412 | 5/1978 | France | 175/61 |
| 878895 | 11/1981 | U.S.S.R. | 75/73 |

*Primary Examiner*—Hoang C. Dang

[57] ABSTRACT

A directional drilling assembly comprises a downhole drilling motor and stabilizer assembly which stabilizes the drilling assembly in such a manner in the borehole that the drilling bit driven by the output shaft of the downhole motor has a tilted orientation in the borehole. The stabilizer assembly comprises a lowermost stabilizer which is connected to the output shaft of the motor so as to suppress any sticking tendency of said lowermost stabilizer to the borehole wall.

25 Claims, 4 Drawing Sheets

FIG. 1A
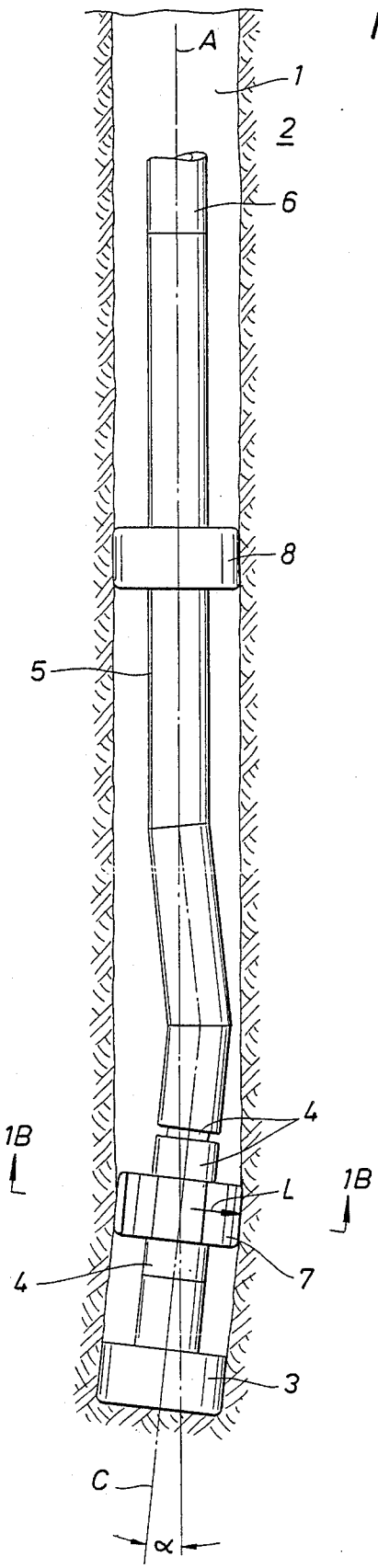
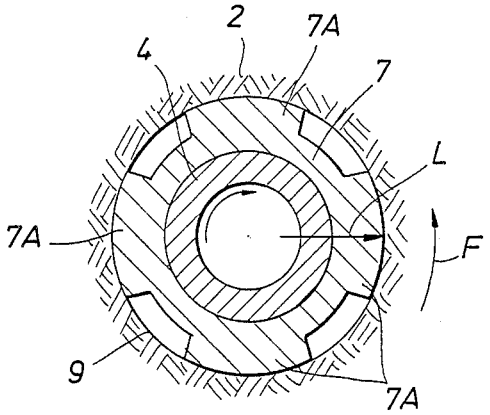
FIG. 1B

ASSEMBLY FOR DIRECTIONAL DRILLING OF BOREHOLES

BACKGROUND OF THE INVENTION

The invention relates to an assembly for directional drilling of boreholes in subsurface formations.

During drilling of boreholes in subsurface formations it may be necessary to vary or adjust the direction of drilling from time to time. Various directional drilling tools are known in the art which are able to steer the bit in a desired direction.

European patent specifications No. 0085444 and 0109699, U.S. Pat. Nos. 4,465,147 and 4,492,276, respectively, disclose directional drilling tools which comprise a downhole motor provided with stabilizer means that stabilize the motor housing in such a manner in the hole that the bit driven by the motor has a tilted orientation in the hole. The steering capability of these motors is based on the fact that if the drill string carrying the motor housing is kept non-rotating during drilling the bit will deepen the hole in a deviated direction, whereas if the drill string carrying said housing is rotated during drilling the resulting gyrating movement of the bit causes the bit to deepen the hole in a straight direction. Hence, the drilling assemblies known from these patents are able to drill alternately straight and deviated borehole sections by alternately rotating and not-rotating the drill string carrying the motor.

Field experience with the drilling assemblies known from the above patents has proved that these assemblies are very suitable and cost effective directional drilling tools which are able to continuously steer the bit in an accurate manner during drilling. Detailed examination of the path and shape of boreholes that have been drilled with these assemblies revealed however that during drilling of deviated hole sections in some formations the lateral forces exerted to the stabilizers may cause high friction forces between the blades of, in particular, the lowermost stabilizer and the borehole wall. It was found that this sticking of the stabilizer blades to the borehole wall resulted in a decrease in drilling progress during drilling of deviated hole sections.

SUMMARY OF THE INVENTION

The present invention aims to provide a directional drilling assembly which is able to achieve a high drilling progress even during drilling of deviated hole sections.

The drilling assembly according to the invention thereto comprises a downhole drilling motor and stabilizing means for stabilizing the assembly in a borehole such that in use an output shaft of the motor has a tilted orientation in the borehole, wherein said stabilizing means comprise a lowermost stabilizer which is secured to said output shaft.

Said lowermost stabilizer may be mounted on said output shaft itself, or on a drill bit driven by the shaft, or on a tubular element mounted above or below the shaft. The arrangement according to the invention provides a lowermost stabilizer on or below the output shaft (instead of mounting said stabilizer on the motor housing as known from the above-mentioned patents) has the principal advantage that the lowermost stabilizer rotates even during deviated drilling when the motor housing is kept stationary. In this manner the sticking tendency of the lowermost stabilizer is eliminated even if high lateral loads are exerted to said stabilizer as may happen in highly deviated boreholes. A further advantage of the arrangement according to the invention is that the lowermost stabilizer is located close to the bit which is useful for stable steering of the bit.

The drilling assembly may be stabilized further up the hole by one or more other stabilizers. These other stabilizers may be mounted on the motor housing and/or on drill string sections located above the motor housing.

In highly deviated or horizontal boreholes it may be desired to mount also these second and further stabilizers in such a manner on the drilling assembly that they rotate continuously even during drilling of deviated hole sections so as to avoid any sticking tendency of these stabilizers. This may be achieved in accordance with a preferred embodiment of the present invention by mounting the second and further stabilizers on a drill string section above the motor housing and by arranging a second downhole motor between said other motor and string section, which second motor having a housing which is connected to the housing of said other motor, and a shaft which is connected to said drill string section.

During deviated drilling the interconnected housings of the twin motor assembly thus provided can be kept non-rotating in a desired orientation in the borehole by rotating the upper motor in an opposite direction but at the same speed as the drill string carrying the motors. During straight hole drilling the upper motor may be rotated at a speed different from the speed of rotation of the drill string.

BRIEF DESCRIPTION OF THE DRAWINGS

The invention will now be explained in more detail with reference to the accompanying drawings, in which:

FIG. 1A illustrates a side elevational view of a directional drilling assembly according to the invention comprising a drilling motor of which the housing has a tilted shape;

FIG. 1B is a cross-sectional view of the directional drilling assembly of the present invention taken along line 1B—1B of FIG. 1A;

DETAILED DESCRIPTION OF THE PREFERRED EMBODIMENTS

Figure 2:
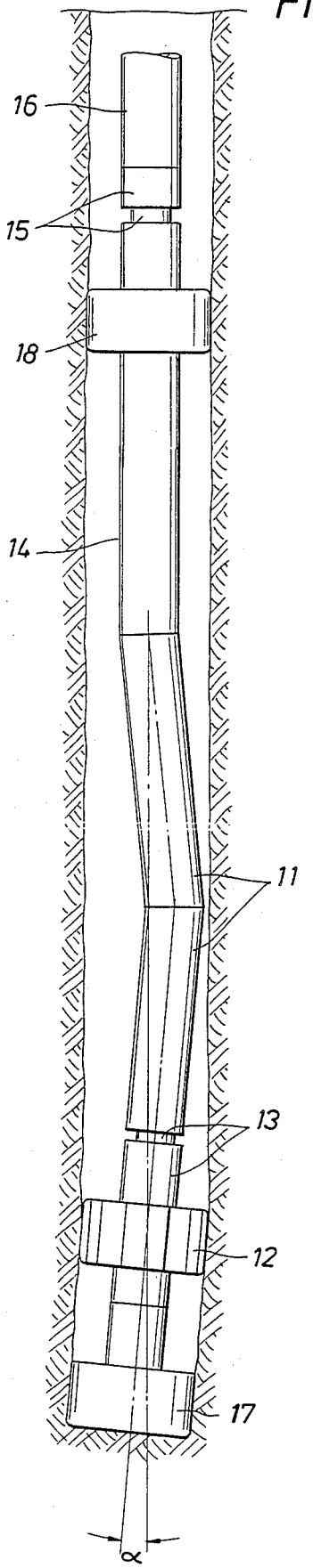
FIG. 2 illustrates a side elevational view of an embodiment of the invention wherein a concentric second stabilizer is mounted on a housing of a twin drilling motor assembly.

In FIG. 1A there is shown a directional drilling assembly according to the invention located in a borehole 1 in an underground formation 2. The assembly comprises a rotary drill bit 3 which is connected to the output shaft 4 of a downhole drilling motor, which motor is arranged at the lower end of a drill string 6. The motor is a Moineau motor which is driven by the drilling fluid flowing through the drill string 6. The motor housing 5 has a tilted shape in order to orient the output shaft 4 and bit 3 at a predetermined tilt angle $\alpha$ relative to the longitudinal axis A of the borehole 1. The motor is provided with a lowermost stabilizer 7 and a second stabilizer 8 which stabilize the assembly in a substantially centralized position in the borehole 1.

The lowermost stabilizer 7 is mounted on the output shaft 4 and the second stabilizer 8 is mounted on the motor housing 5. The stabilizers 7 and 8 are bladed stabilizers and as can be seen in FIG. 1B the lowermost stabilizer 7 is mounted concentrically around the hollow output shaft 4.

As will be explained hereinbelow the arrangement of the lowermost stabilizer 7 on the output shaft 4 has the advantage that the stabilizer 7 is rotated continuously during drilling so that any sticking tendency of the blades 7A of the stabilizer 7 against the borehole wall 9 is suppressed. During drilling operations the output shaft 4 is continuously actuated by the flow of drilling fluid through the motor to rotate relative to the motor housing 5. If by not rotating d=the drill string 6, the motor housing is held non-rotating and the bit 3 will deepen the hole 1 in a deviated direction corresponding to the orientation of the central axis C of the output shaft 4. If the drill string 6 and motor housing 5 are rotated during drilling, the central axis C of the output shaft 4 will make an orbital movement relative to the longitudinal borehole axis A which causes the bit 3 to make a gyrating movement in the hole 1 and to deepen the hole in the direction of the longitudinal axis A. Hence straight and deviated borehole sections can be drilled at will by either rotating or not rotating the motor housing 5 during drilling. The arrangement according to the invention providing the lowermost stabilizer 7 on or below the output shaft 4 has the principal advantage that this stabilizer is rotated continuously relative to the borehole wall, both during straight or deviated hole drilling.

As schematically shown in FIG. 1B the continuous rotation of the lowermost stabilizer 7 ensures that the frictional forces F, which are generated as a result of the lateral forces L, are predominantly tangential and therefore absorbed as motor torque, rather than by an increase in longitudinal friction. In this manner any sticking tendency of the stabilizer 7 to the borehole wall is eliminated. A further advantage of the arrangement according to the invention of the lowermost stabilizer 7 on or below the output shaft 4 is that the stabilizer 7 is located close to the bit 3 which is useful for an optimum steering stability. If desired, the lowermost stabilizer 7 may be undersized in order to stabilize the bit in a substantially centralized position in the borehole 1. If desired, the second stabilizer 8 may be undersized as well and be mounted on the drill string 6 above the motor housing 5.

FIG. 2 shows an embodiment of the present invention wherein a housing 11 of a downhole motor carrying a lowermost stabilizer 12 below its output shaft 13 is secured t the housing 14 of a second motor having a shaft 14 which is screwed to the lower end of a drill string 16. The housings 11, 14 of the twin motor arrangement thus provided can be held stationary in the borehole by inducing said second motor to rotate at the same speed as the drill string 16 above the motors but in an opposite direction. In the example shown, the second motor is a positive displacement motor such as a Moineau motor. The speed of rotation of such a hydraulically driven motor can be accurately regulated by pumping a selected flow of drilling fluid through the drill string 16. In order to keep the motor housings stationary in a desired orientation, a by-pass valve (not shown) may be located in said second motor. The valve is then opened during a selected period of time if survey instruments (e.g. gravitometers, magnetometers or gyroscopes) carried by the motor housings 11, 14 indicate that the housings are not oriented at a desired rotational orientation in the borehole.

During straight hole drilling, when it is desired that the motor housings 11, 14 rotate inside the borehole so as to induce the bit 17 to describe a gyrating movement, the flow of drilling fluid through the drill string 16 is regulated such that the motor housings 11, 14 rotate at a different speed than the drill string 16 itself.

During operation of the assembly shown in FIG. 2, the second stabilizer 18 which is mounted on the housing 14 of the second motor is rotated only during straight hole drilling, whereas the lowermost stabilizer 12 and the drill string 16 are rotated continuously both during deviated and straight hole drilling. In this manner not only sticking of said lowermost stabilizer 17 is suppressed, but also sticking to the borehole wall of the drill string 16 and any stabilizers (not shown) mounted thereon. The sticking forces exerted on the second stabilizer 18 stabilize the orientation of the dual motor housing 11, 14 during deviated drilling.

Figure 3:
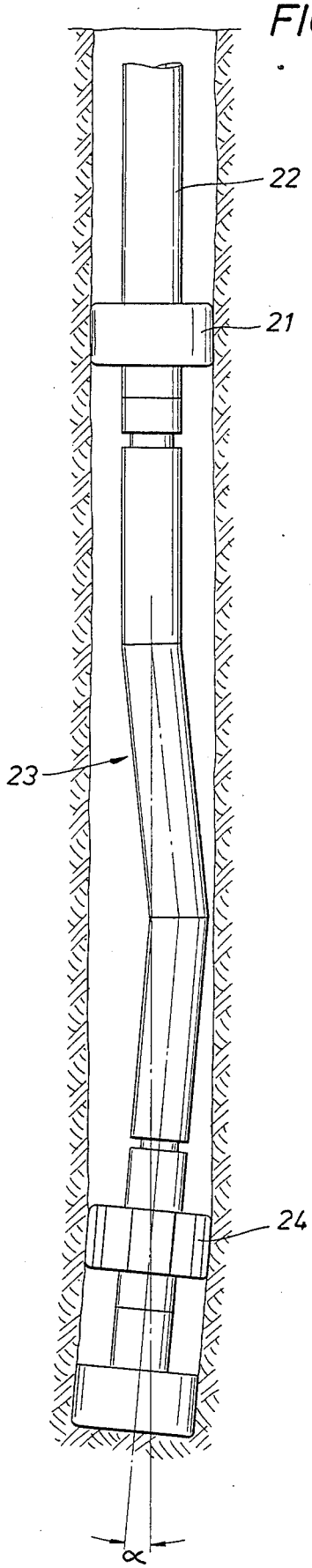
FIG. 3 illustrates a side elevational view of an embodiment of the invention wherein a concentric second stabilizer is mounted on a drill string section above a twin drilling motor assembly.

As illustrated in FIG. 3, the second stabilizer may also be located such that it is rotated continuously during drilling. This is accomplished in the assembly of FIG. 3 by mounting the second stabilizer 21 near the lower end of a drill string 22 carrying a twin motor assembly 23. The construction and operation of the twin motor assembly 23 is similar to those of the twin motor assembly shown in FIG. 2 apart from the arrangement of the second stabilizer 21 on the drill string instead of on the motor housings. The configuration shown in FIG. 3 has the advantage that the assembly comprises only continuously rotating components which are in contact with the borehole wall. The configuration of FIG. 3 is therefore particularly attractive for drilling sharply curved and highly deviated or horizontal holes. Large contact forces may exist in such holes along the length of the drill string between the outer surface of the string and the borehole wall. The tendency of sticking of any of these stabilizers to the borehole wall is suppressed so that a smooth drilling progress is ensured by continuously rotating the lowermost stabilizer 24, the second stabilizer 21 and any other stabilizer carried by the string 22.

Figure 4:
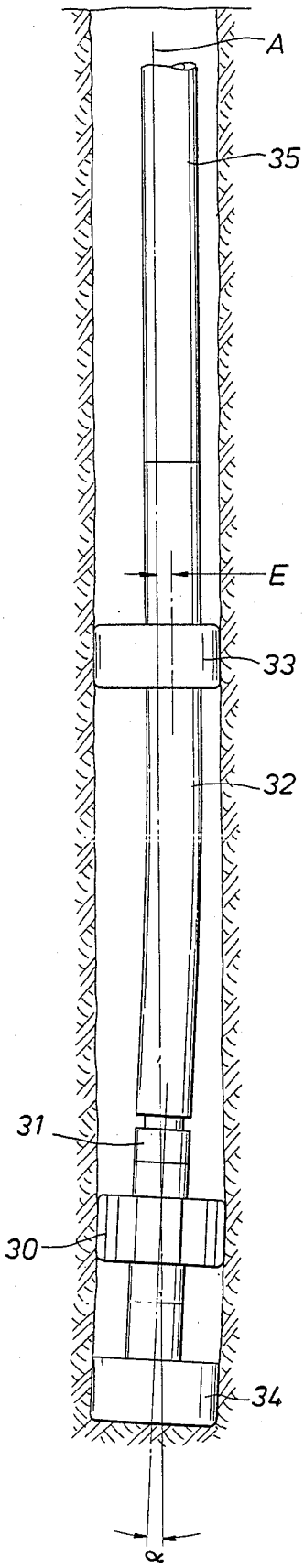
FIG. 4 illustrates a side elevational view of an embodiment of the invention wherein an eccentric second stabilizer is mounted on the motor housing.

FIG. 4 shows another embodiment of the present invention wherein the lowermost stabilizer 30 is mounted below the output shaft 31 of a downhole motor which carries on the housing 32 thereof an eccentric second stabilizer 33. The eccentricity E of the second stabilizer 33 is selected such that a drill bit 34 carried by the output shaft 31 is oriented at a predetermined tilt angle α relative to the longitudinal borehole axis A. The motor housing 32 is connected to the lower end of a drill string 35, which string is rotated during straight hole drilling and held stationary during deviated hole drilling in the same manner as the string disclosed in FIG. 1A is operated during drilling. The only difference between the drilling assemblies of FIGS. 1A and 4 is the arrangement of an eccentric second stabilizer 33 is orient the bit at a tilt angle α instead of accomplishing this by a concentric second stabilizer which is mounted on a tilted motor housing.

Figure 5:
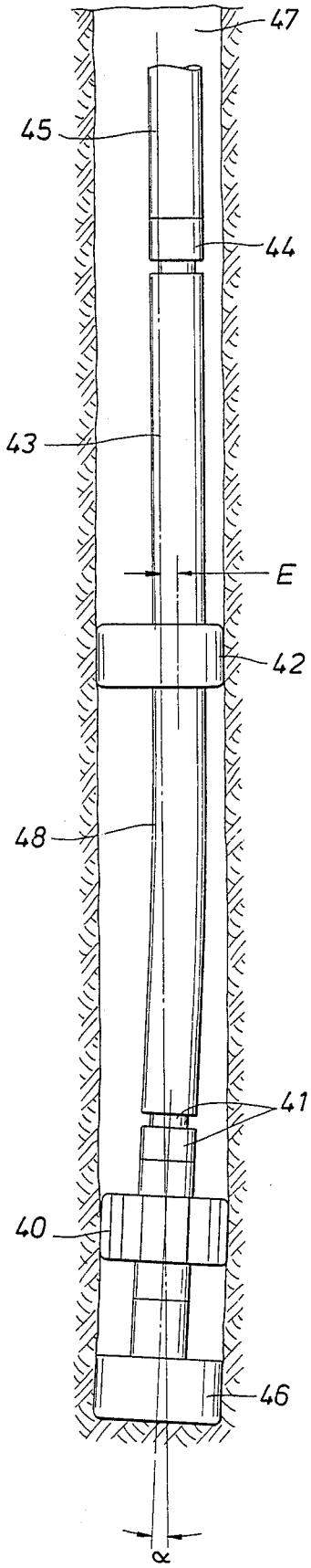
FIG. 5 illustrates a side elevational view of an embodiment of the invention wherein an eccentric second stabilizer is mounted on a housing of a twin drilling motor assembly.

FIG. 5 shows an embodiment of the present invention wherein a lowermost stabilizer 40 is mounted below an output shaft 41 of a twin motor assembly which carries an eccentric second stabilizer 42. Said second stabilizer 42 is mounted on the housing 43 of the upper motor of the assembly, which motor has a shaft 44 that is secured to the lower end of a rotary drill string 45. The eccentricity E of the second stabilizer 42 is selected such that a bit 46 carried by the output shaft 41 is oriented at a predetermined tilt angle α in the borehole 47.

The operation of the assembly shown in FIG. 5 is similar to the operation of the assembly shown in FIG. 2. During deviated hole drilling the housing 43, 48 are held non-rotating in the hole by rotating them in an opposite direction, at the same speed, relative to the drill string 45, whereas during straight hole drilling the housings 43, 48 are rotated relative to the drill string 45 at a speed different from the speed of rotation of the string. In this way it is accomplished that the lowermost stabilizer 40 and any further stabilizers (not shown) mounted on the drill string 45 are continuously rotated both during deviated and straight hole drilling so that any sticking tendency of these stabilizers to the borehole wall is suppressed.

The motors of the twin motor assembly detailed above may be identical to each other so as to provide a "hydraulic shaft" between the drill string 45, and bit 46. However, the motors may also be of a different size or construction.

Instead of using a twin motor assembly to keep the output shaft in a stationary orientation in the borehole while rotating the drill string this may be accomplished by a single motor as well. In the drilling assemblies shown in FIG. 6 and 7 this is accomplished by providing a single motor with a rotor which is connected both to the drill bit and to the drill string above the motor.

Figure 6:
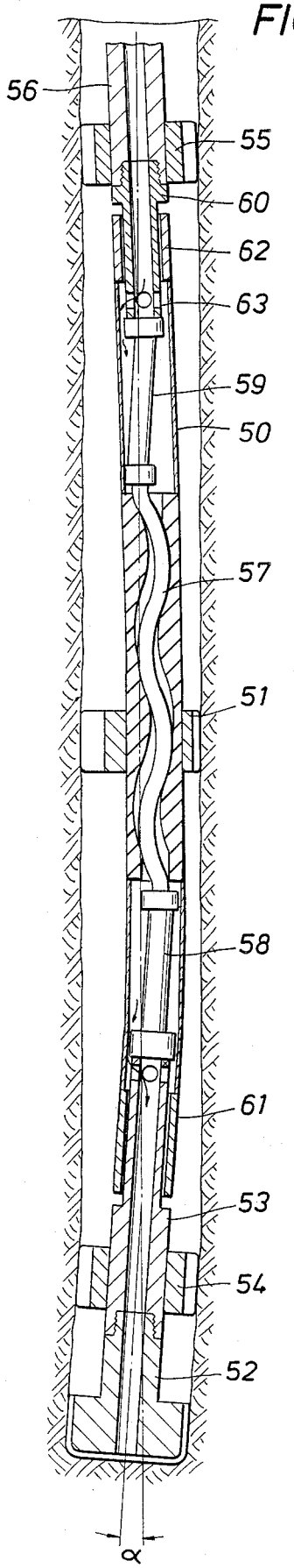
FIG. 6 illustrates a longitudinally cross-sectional view of an embodiment of the invention wherein an eccentric stabilizer is mounted on the housing of a motor having a rotor which is connected via a second shaft to the lower end of a drill string.

The assembly shown in FIG. 6 comprises a Moineau motor having a housing 50 on which an eccentric second stabilizer 51 is mounted in order to orient a drill bit 52 carried by an output shaft 53 of the motor at a predetermined tilt angle α in the borehole. The assembly is further stabilized in the borehole by a lowermost stabilizer 54 mounted on the output shaft 53 and by a third stabilizer 55 which is mounted near the lower end of the drill string 56 above the motor. The motor comprises a rotor 57 which is connected to the output shaft 53 by a universal joint 58 and to the lower end of the drill string 56 by a second universal joint 59 and a second shaft 60. Thus the rotor 57 forms a "flexible shaft" between the drill string 56 and drill bit 52, so that the drill bit 52 always rotates at the same speed as the drill string 56.

The housing 50 is guided relative to the shafts 53 and 60 by two bearing units 61 and 62, respectively. During drilling, the drill string 56 is continuously rotated and drilling fluid is pumped via the string 56, the hollow second shaft 60 and radial fluid inlet ports 63, into the motor to actuate the motor housing 50 to rotate in an opposite direction relative to the drill string 56. Thus the housing 50 operates as a "bent sleeve" which rotates about the flexible shaft formed by the rotor 57 and two shafts 53, 60. The speed of rotation of the housing 50 relative to the rotor 57 is regulated by pumping a selected flow of drilling fluid via the drill string 56 into the motor. The housing 50 will be held in a stationary position in the borehole if it rotates in said opposite direction at the same speed as the drill string 56, whereas the housing 50 will rotate inside the borehole if it rotates at a speed different from the speed of rotation of the drill string 56.

Thus, by varying the flow of drilling fluid through the assembly the housing 50 can either be held stationary in the borehole thereby enabling the bit to deepen the hole in a deviated direction or be rotated thereby inducing the bit to describe a gyrating motion and to deepen the hole in a straight direction. Drilling of straight and deviated borehole sections can be accomplished in this manner, by adjusting the ratio between the speed of drill string rotation and the amount of drilling fluid pumped through the string. Alternatively, the flow through the motor can be controlled by a bypass valve, which is controlled by e.g. gravitational, magnetic or gyroscopic sensors. The bypass flow may be routed via the annulus or via inside of a hollow rotor, or by a bypass which is parallel to the motor.

The lowermost stabilizer 54 and third stabilizer 55 are continuously rotated during drilling with the assembly shown in FIG. 6, thereby eliminating any sticking tendency of these stabilizers to the borehole wall.

Figure 7:
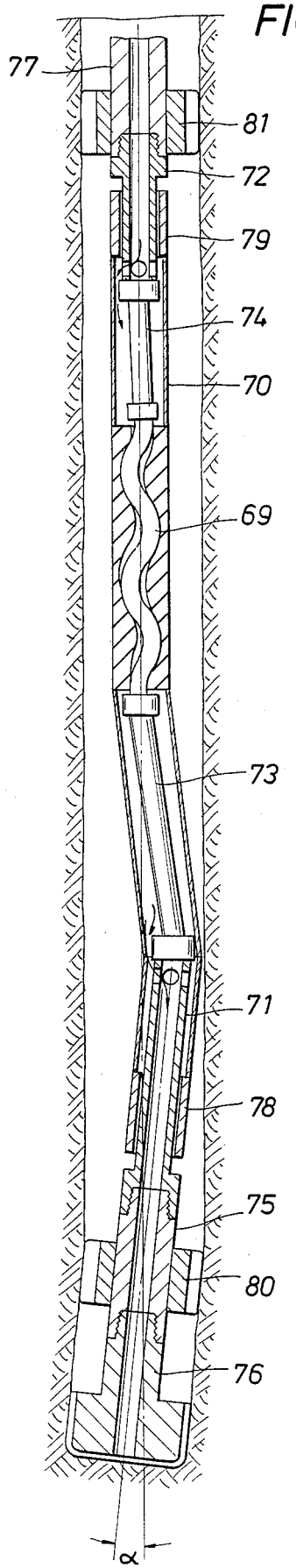
FIG. 7 illustrates a longitudinally cross-sectional view of yet another embodiment of the invention wherein a second stabilizer is mounted on a drill string which is connected via a second shaft to the rotor of a motor having a tilted housing.

The Moineau motor operation of the embodiment shown in FIG. 7 is similar to that of the motor shown in FIG. 6. The motor shown in FIG. 7 comprises a tilted housing 70 and a rotor 69 which is connected to an output shaft 71 and a second shaft 72 by a pair of universal joints 73, 74, respectively. The output shaft 71 is connected to a tubular section 75 which carries a drill bit 76 and the second shaft 72 is connected to the lower end of a drill string 77.

The housing 70 is guided relative to the two shafts 71, 72 by two bearing units 78, 79, respectively, and the assembly is stabilized in the borehole by a lowermost stabilizer 80 mounted on said tubular section 75 below the output shaft 71 and a second stabilizer 81 mounted at the lower end of the drill string 77. The stabilizers 80, 81 stabilize the assembly in such a manner in the borehole that the drill bit 76 is oriented at a predetermined tilt angle α in the borehole.

The rotor 69, universal joints 73, 74, shafts 71, 72 and tubular section 75 provide a "flexible shaft" between the drill string 77 and drill bit 76.

During drilling the drill string 77 is continuously rotated whereas the housing 70 is rotated in an opposite direction either at the same or at a different speed so as to drill either deviated or straight borehole sections.

Since the lowermost stabilizer 80 and second stabilizer 81 are continuously rotated during drilling, any sticking tendency of these stabilizers to the borehole wall is eliminated.

Various types of downhole motors may be utilized in the assembly according to the invention. Suitable motors are electric motors or hydraulic motors such as turbines, vane motors, roller vane motors and Moineau motors, It is preferred to use Moineau motors in view of their impassiveness for misalignment of the output shaft relative to the other motor parts, and the direct proportionality of output shaft speed to flow rate.

It will be understood that any suitable type of stabilizer may be used in the drilling assembly according to the invention. Particularly suitable stabilizers are bladed stabilizers provided with helical or straight blades.

It will further be understood that the lowermost stabilizer in the assembly according to the invention may be mounted on the output shaft of the drilling motor assembly, or on a drill bit carried by said shaft, or on a tubular element mounted between the output shaft and bit. If the lowermost stabilizer is mounted on the drill bit, the stabilizer blades may be mounted above, between, or be formed by wings which carry the cutting elements of the bit and protrude in lateral direction away from the bit body. If, on the other hand, it is desired to locate the lowermost stabilizer at a distance above the bit, the stabilizer may be secured to the upper end of the output shaft and surround the lower part of the motor housing.

Many other modifications may be made in the construction of the assembly hereinbefore described without departing from the scope of the appended claims. Accordingly, it should be clearly understood that the embodiments of the invention shown in the accompanying drawings are illustrative only.

What is claimed is:

1. A drilling assembly for directional drilling of boreholes in subsurface formations, the assembly comprising
   a downhole drilling motor, said motor having an output shaft which is suitable to drive a rotary drill bit and a motor housing which is suitable to be arranged at the lower end of a drill string;
   stabilizing means for stabilizing the assembly;
   means in the assembly for permanently tilting the central axis of the output shaft with respect to the longitudinal axis of the drill string in the borehole;
   characterized in that said stabilizing means include a lowermost stabilizer which is secured to and rotates with said output shaft.

2. The assembly of claim 1, wherein said lowermost stabilizer is mounted concentrically on said output shaft.

3. The assembly of claim 1, wherein said lowermost stabilizer is mounted on a tubular element which is connected to the lower end of said shaft.

4. The assembly of claim 1, wherein said lowermost stabilizer is mounted on a shank of a rotary drill bit carried by said shaft.

5. The assembly of claim 1, wherein said stabilizing means further comprises a second stabilizer which is mounted on the motor housing.

6. The assembly of claim 5, wherein said second stabilizer is mounted eccentrically on said motor housing.

7. The assembly of claim 5, wherein said second stabilizer is mounted concentrically on said motor housing.

8. The assembly of claim 7, wherein said motor housing has a second stabilizer and an upper section and a lower section, a central axis of the lower section intersecting a central axis of the upper section between the lowermost and the second stabilizer.

9. The assembly of claim 1, wherein the stabilizing means comprises a second stabilizer which is mounted on a drill string section above the motor housing.

10. The assembly of claim 9, wherein between said drill string section and motor housing a second downhole motor is arranged, said second motor having a housing which is connected to the housing of said other motor and a shaft which is connected to said drill string section.

11. The assembly of claim 1, wherein said motor comprises a rotor which is connected to the output shaft and via a second shaft to the drill string above the motor.

12. The assembly of claim 1, wherein the downhole motor is a hydraulically driven motor of the Moineau type.

13. A drilling assembly mountable on the lower end of a drill string for directionally drilling a borehole in a subsurface formation, comprising:
   a rotary drill bit;
   a downhole drilling motor, comprising:
      a motor housing connected to the lower end of the drill string;
      at least a first downhole motor within the housing;
      said first downhole motor having an output shaft; and
   means for stabilizing the drilling assembly including a lowermost stabilizer fixedly secured to and rotating with the output shaft; and
   means in the assembly for permanently tilting the central axis of the output shaft with respect to the longitudinal axis of the drill string in the borehole.

14. A drilling assembly in accordance with claim 13, wherein said lowermost stabilizer is mounted concentrically on said output shaft.

15. A drilling assembly in accordance with claim 13, wherein said lowermost stabilizer is mounted on a tubular element which is connected to the lower end of said shaft.

16. A drilling assembly in accordance with claim 13, wherein said rotary drill bit has a shank and said lowermost stabilizer is mounted on the shank of the rotary drill bit.

17. A drilling assembly in accordance with claim 13, wherein said means for stabilizing the drilling assembly further comprises a second stabilizer which is mounted on the motor housing.

18. A drilling assembly in accordance with claim 17, wherein said second stabilizer is mounted eccentrically on said motor housing.

19. A drilling assembly is accordance with claim 17, wherein said second stabilizer is mounted concentrically on said motor housing.

20. A drilling assembly in accordance with claim 19, wherein said motor housing has an upper section and a lower section a central axis of the lower section intersecting a central axis of the upper section between the lowermost and the second stabilizer.

21. A drilling assembly in accordance with claim 13, wherein the means for stabilizing the drilling assembly comprises a second stabilizer which is mounted on a drill string section above the motor housing.

22. A drilling assembly in accordance with claim 21, wherein a second downhole motor is arranged between a lower end of the drill string section and the motor housing, said second downhole motor having a second motor housing which is connected to the motor housing of the first downhole motor and a shaft which is connected to the lower end of the drill string.

23. A drilling assembly in accordance with claim 21, wherein said first downhole motor comprises a rotor which is connected to the output shaft and via a second shaft to the drill string above the motor.

24. A drilling assembly in accordance with claim 13 wherein the first downhole motor is a hydraulically driven motor of the Moineau type.

25. A drilling assembly in accordance with claim 22, wherein the first and second downhole motors are each a hydraulically driven motor of the Moineau type.

* * * * *